US011178489B2

(12) United States Patent
Ayoub et al.

(10) Patent No.: US 11,178,489 B2
(45) Date of Patent: Nov. 16, 2021

(54) AUDIO CONTROL MODULE

(75) Inventors: Ramy S Ayoub, Arlington Heights, IL (US); Brian J Sibilsky, Austin, TX (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 13/364,934

(22) Filed: Feb. 2, 2012

(65) Prior Publication Data

US 2013/0201397 A1 Aug. 8, 2013

(51) Int. Cl.

*H04R 5/04* (2006.01)
*H04R 5/033* (2006.01)
*H04R 1/10* (2006.01)

(52) U.S. Cl.

CPC ..... *H04R 5/04* (2013.01); *H04R 1/1041* (2013.01); *H04R 5/033* (2013.01); *H04R 2420/03* (2013.01); *H04R 2420/05* (2013.01); *H04R 2420/09* (2013.01); *H04R 2430/01* (2013.01)

(58) Field of Classification Search

CPC .... H04N 5/60; H04N 9/475; H04N 21/43635; H04N 21/43637; H04N 21/4305; H04N 21/4396; H04N 21/4398; H04N 21/44231; H04M 1/24; H04M 1/7253; H04M 1/72558; H04M 1/72412; H04M 1/72442; H04R 5/04; H04R 5/033; H04R 2420/09; H04R 2430/01; H04R 1/1041; H04R 2420/03; H04R 2420/05; H04J 3/0632; H04B 17/21

See application file for complete search history.

(56) References Cited

U.S. PATENT DOCUMENTS 8,204,256 B2 6/2012 Ozaki et al.
2006/0156376 A1* 7/2006 Mukaide ..... H04L 29/06027 725/135
2008/0291863 A1* 11/2008 Agren ..... H04N 21/43637 370/315
2008/0309830 A1* 12/2008 Motomura ..... H04N 21/4398 348/738
2010/0053471 A1* 3/2010 Shikata ..... H04N 5/60 348/738

(Continued)

FOREIGN PATENT DOCUMENTS

WO WO 2013/100933 A1 * 7/2013

OTHER PUBLICATIONS

Hound Dog Hearing, "TV Ears Headsets for Persons with Hearing Loss", http://www.hdhearing.com/tv/tvears.htm, 2001, 6 pages.

(Continued)

*Primary Examiner* — Yogeshkumar Patel
(74) *Attorney, Agent, or Firm* — Buchanan, Ingersoll & Rooney PC

(57) ABSTRACT

In embodiments of an audio control module (318), audio data (310) is received from an audio data source (314) for output to an audio rendering device (316). An initialization input (326) can be received from a wireless audio headset (320) and, responsive to receiving the initialization input, the audio data (328) is communicated to the audio headset. The audio that would be generated from the audio data (322) at the audio rendering device (316) is also limited, such as by replacing the audio data (322) with null audio data, clearing audio data packets from the audio data (322), or by asserting a mute signal (336) to the audio rendering device.

20 Claims, 8 Drawing Sheets

(56) References Cited

U.S. PATENT DOCUMENTS

2010/0315553 A1* 12/2010 Takatsuji ..... G06F 21/10
348/516
2011/0275320 A1* 11/2011 Pattenden ..... H04M 1/72442
455/41.2

OTHER PUBLICATIONS

Harris Communications, "ClearBlue Bluetooth TV/Audio Listening System HC-CLTVBT", http://www.harriscomm.com/catalog/product_info.php?cPath=48&products_id=20477, Sep. 18, 2002, 2 pages.
Motorola, "S9 Product Layout", https://motorola-global-portal.custhelp.com/app/answers/detail/a_id/3226/kw/motorokr%252, accessed Jun. 28, 2011, 2 pages.
Audioholics, "Atlona Tech AT-HD570 HDMI (1.3) Audio De-Embedder", http://www.audioholics.com/reviews/cables/atlona-tech-at-hd570, May 21, 2009, 2 pages.
Headroom, "About Speech Intelligibility In TV And Movie Listening", http://www.headphone.com/selection-guide/tv-and-movies.php, accessed from Internet Aug. 25, 2012, 3 pages.
Amazon.com, "Sennheiser RS 180 Digital Wireless Headphone System", http://www.amazon.com/Sennheiser-RS-180-Wireless-Headphone/dp/B002TLT10S/ref=pd_sim_e_3, accessed from Internet Aug. 25, 2012, 6 pages.

* cited by examiner

600

| Byte # | 7 | 6 | 5 | 4 | 3 | 2 | 1 | 0 |
|---|---|---|---|---|---|---|---|---|
| 0 | Vendor-specific tag code (=3) | | | Length (=N) | | | | |
| 1 | 24-bit IEEE Registration Identifier (0x000C03) (least significant byte first) | | | | | | | |
| 2 | | | | | | | | |
| 3 | | | | | | | | |
| 4 | A | | | | B | | | |
| 5 | C | | | | D | | | |
| 6 | Supports_AI | DC_48bit | DC_36bit | DC_30bit | DC_Y444 | Rsvd (0) | Rsvd (0) | DVI_Dual |
| 7 | Max_TMDS_Clock | | | | | | | |
| 8 | Latency_Fields_Present | I_Latency_Fields_Present | Rsvd (0) | Rsvd (0) | Rsvd (0) | Rsvd (0) | Rsvd (0) | Rsvd (0) |
| (9) | Video_Latency | | | | | | | |
| (10) | Audio_Latency | | | | | | | |
| (11) | Interlaced_Video_Latency | | | | | | | |
| (12) | Interlaced_Audio_Latency | | | | | | | |
| 9, 11 or 13*...N | *Reserved (0)*** | | | | | | | |

Extension Fields

602

FIG. 6

AUDIO CONTROL MODULE

BACKGROUND

Generally, households, businesses, and other establishments include a growing number of electronic and entertainment devices, such as televisions and cable set-top boxes, DVD and Blu-Ray players, and other general audio/video entertainment devices and systems. It is not unusual for most households to have multiple televisions all on at the same time, and all adding to an overall increased noise level throughout a home. The audio output from more than one entertainment system or device can be an annoyance to a viewer who is, for example, watching a movie but can also hear a commercial that is shown on a different television in another part of the house. Further, the audio output from an entertainment system or device may be intrusive to others that may want to read, study, talk on the phone, or just relax in a quiet environment. In other environments, such as a sports bar or restaurant that has multiple televisions to show a variety of sporting events at the same time, the audio from all of the televisions is likely muted so that there is no conflicting audio. However, unless all of the televisions are tuned to show the same event, a patron can only watch the various sporting events without the corresponding audio.

BRIEF DESCRIPTION OF THE DRAWINGS

Embodiments of an audio control module are described with reference to the following Figures. The same numbers may be used throughout to reference like features and components that are shown in the Figures:

FIG. 6 illustrates an example of HDMI VSDB latency fields.

DETAILED DESCRIPTION

In embodiments of an audio control module, a privacy mode can be initiated by a user wanting to watch a movie or television program, yet listen in privacy without subjecting others to the audio that corresponds to the movie or television program. The audio control module is implemented in-line between an HDMI source (e.g., a television set-top box that is a source of media data) and an HDMI sink (e.g., a television and/or home theater system). For example, the user can initiate the privacy mode from an audio headset when watching a movie at home so that the audio is routed to the audio headset while the movie continues to be displayed for viewing on a television or other type of display device.

When the privacy mode is initiated, the audio control module also eliminates the audio being rendered at the television or through speakers so that another person in the same or another room of the house will not be subjected to the movie audio. In another viewing scenario, a sports bar may have multiple televisions to show a variety of sporting events at the same time, and the audio from all of the televisions is likely muted so that there is no conflicting audio. In embodiments of an audio control module, a patron in the sports bar can initiate connecting an audio headset with the audio control module that is associated with the sporting event when the person also wants to hear the corresponding audio.

While features and concepts of an audio control module can be implemented in any number of different devices, systems, and/or configurations, embodiments of an audio control module are described in the context of the following example devices, systems, and methods.

Figure 1:
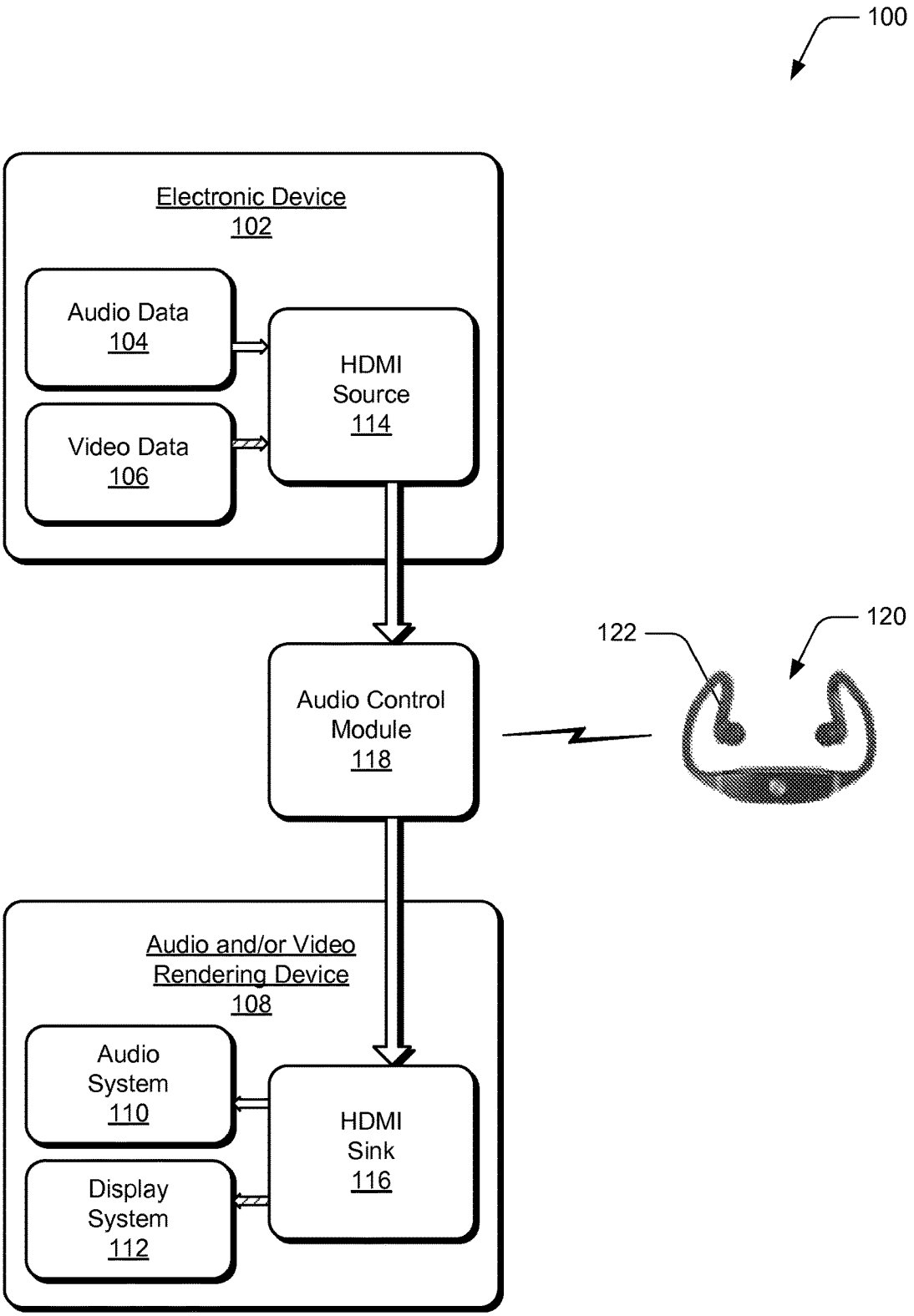
FIG. 1 illustrates an example system in which embodiments of an audio control module can be implemented.

FIG. 1 illustrates an example system 100 in which embodiments of an audio control module can be implemented and utilized to initiate a privacy mode, such as when watching television, playing a video game, and/or listening to streaming music. The example system 100 includes an electronic device 102, such as any one or combination of a television set-top box, digital video recorder (DVR), computer device, gaming system, or any other type of device that is a source of audio data 104 and/or video data 106.

The example system also includes an audio and/or video rendering device 108, such as any one or combination of a display device, television, home-theatre system, stereo system, or any other type of device that includes an audio system 110 to render the audio data and/or a display system 112 to render the video data. For example, a television set-top box can route media data (e.g., the audio data and associated video data) as a television program or a movie via a high-definition multimedia interface (HDMI) source 114 to a television device that receives the audio data and the video data via an HDMI sink 116. In implementations, the HDMI source and the HDMI sink are media data ports configured to route the media data between the devices. Additionally, the electronic device 102 and the audio and/or video rendering device 108 can each be implemented with any combination of differing components as further described with reference to the example electronic device 800 shown in FIG. 8.

In the example system 100, an audio control module 118 is implemented in-line between the HDMI source 114 and the HDMI sink 116, and the audio control module routes the audio data and the video data from the HDMI source through to the HDMI sink. Components of the audio control module are described with reference to FIG. 3. In embodiments, the audio control module is implemented to receive an initialization input from an audio headset 120, such as a Bluetooth™ headset that includes a user-selectable push-button 122. A user can initiate connecting the audio headset 120 with the audio control module 118 by depressing the push-button 122 on the audio headset to enable the privacy mode from the headset.

In response to the initialization input received from the audio headset 120, the audio control module 118 is implemented to then communicate the audio data 104 to the audio headset. The audio control module is also implemented to limit the audio that would be generated from the audio data at the audio and/or video rendering device 108. For example, a person at home can initiate a privacy mode when watching a movie so that the audio is routed to the audio headset 120 while the movie continues to be displayed for viewing on a television or other type of display device. Another person in the same or another room of the house will not be subjected to the movie audio.

The audio control module 118 can support various different Bluetooth™ profiles, such as the Advanced Audio Distribution Profile (A2DP) to receive private audio from an HDMI source. Connecting the audio headset 120 with the audio control module can be supported by the Bluetooth Headset Profile (HSP). Other Bluetooth™ profiles that may be utilized include the Hands-Free Profile (HFP) and Audio/Video Distribution Transport Protocol (AVDPT) (implemented for the audio aspect).

Figure 2:
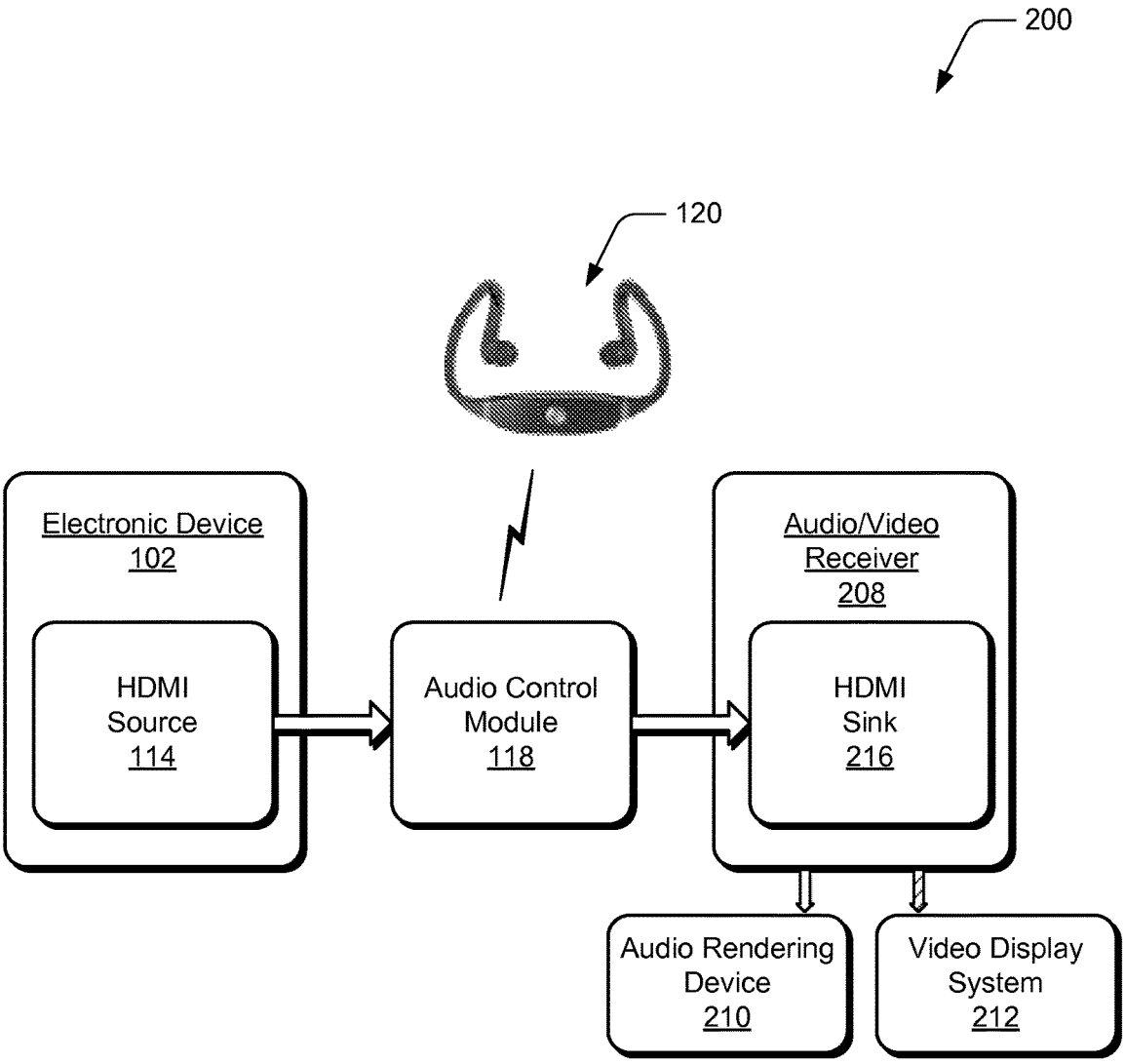
FIG. 2 illustrates another example system in which embodiments of an audio control module can be implemented.

FIG. 2 illustrates another example system 200 in which embodiments of an audio control module can be implemented and utilized to initiate a privacy mode. The example system 200 includes the electronic device 102, which is a source of the audio data and/or video data that is routed as media data via the HDMI source 114. The example system also includes an audio/video receiver 208 that receives the audio data and the video data as an HDMI sink 216. The audio/video receiver can then output the audio data to an audio rendering device 210 or audio system. The audio/video receiver can also output the video data to a video display system 212. For example, a television set-top box can route media data (e.g., the audio data and associated video data) as a television program or a movie via the HDMI source 114 to a home-theatre audio/video receiver that receives the audio data and the video data as the HDMI sink 216. The home-theatre audio/video receiver can then route the audio data to a speaker system, and route the video data to a television or other type of display device. Additionally, the audio/video receiver 208 can be implemented with any combination of differing components as further described with reference to the example electronic device 800 shown in FIG. 8.

In the example system 200, the audio control module 118 is implemented in-line between the HDMI source 114 and the HDMI sink 216, and the audio control module routes the audio data and the video data from the HDMI source through to the HDMI sink. In embodiments, the audio control module 118 can receive an initialization input from the audio headset 120 when initiated by a user, and in response, communicate the audio data to the audio headset. The audio control module is also implemented to then limit the audio that would be generated from the audio data that is routed through the audio/video receiver 208 to the audio rendering device 210.

Figure 3:
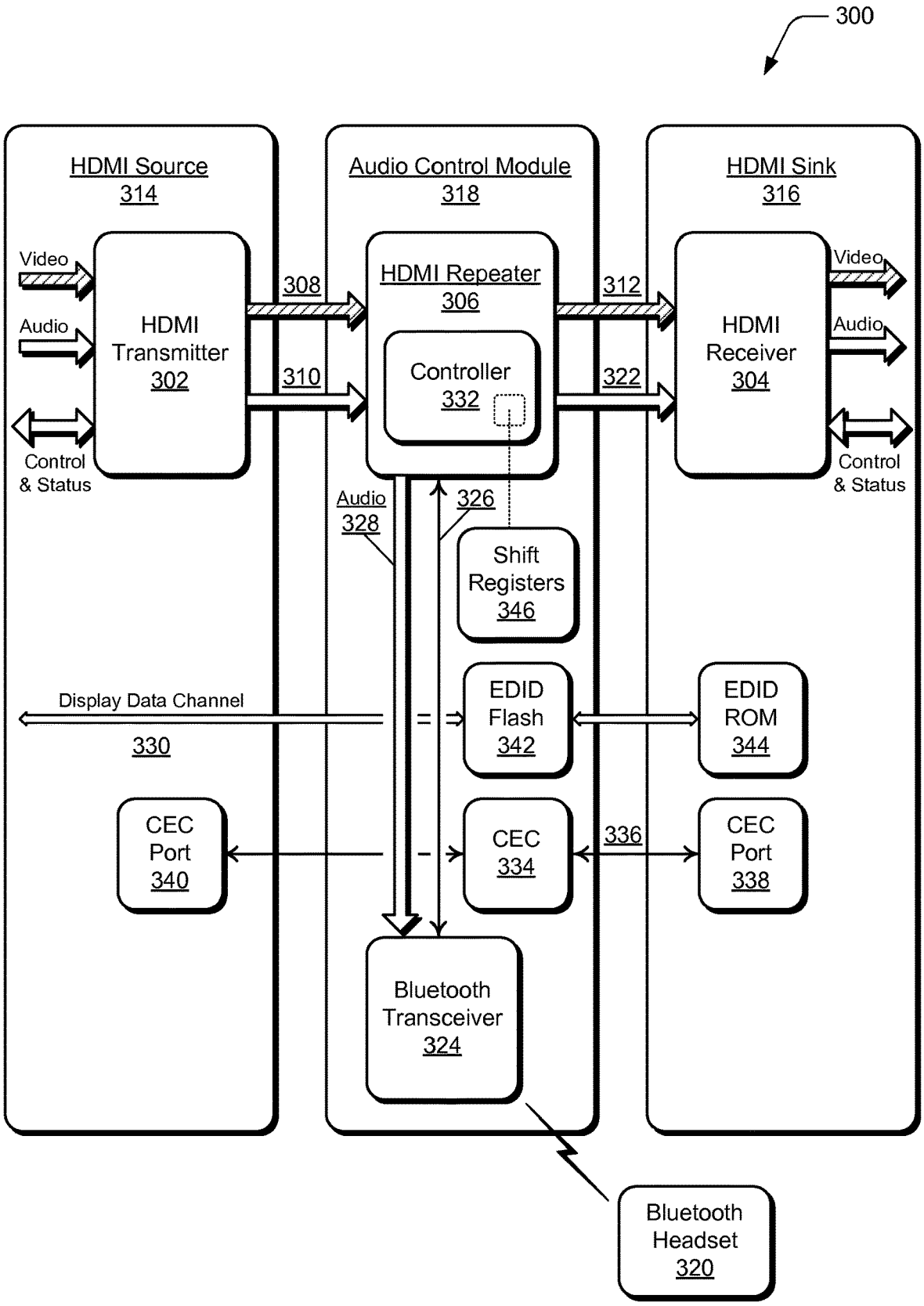
FIG. 3 illustrates an example implementation of an audio control module in accordance with one or more embodiments.

FIG. 3 illustrates an example implementation 300 of an audio control module 318, which is an example of the audio control module 118 described with reference to FIGS. 1 and 2. In the example implementation 300, a High-Definition Multimedia Interface (HDMI) source 314 includes an HDMI transmitter 302, and an HDMI sink 316 includes an HDMI receiver 304. The audio control module 318 is implemented in-line between the HDMI source 314 and the HDMI sink 316, and the audio control module includes an HDMI repeater 306 that routes the audio data and the video data from the HDMI source through to the HDMI sink. For example, the HDMI repeater 306 of the audio control module receives the video data 308 and the audio data 310 from the HDMI transmitter. The HDMI repeater can then route the video data 312 and the audio data 322 to the HDMI receiver. In implementations, the HDMI repeater has High-bandwidth Digital Content Protection (HDCP) support to decrypt and re-encrypt the video signals between the HDMI source and HDMI sink. The video data 308 and 312, and the audio data 310 and 322, can be routed via physical and/or logical ports of the respective HDMI source 314, the audio control module 318, and the HDMI sink 316.

The audio control module 318 includes a transceiver, such as a Bluetooth™ transceiver 324 that is configured for wireless communication with a Bluetooth™ headset 320. The transceiver 324 can receive an initialization input from the audio headset, and then assert a control signal 326 that initiates the HDMI repeater 306 to route the audio data at 328 to the transceiver for communication to the audio headset. A user can invoke the privacy mode from the Bluetooth™ headset by depressing a push-button 122 (FIG. 1) on the audio headset. The privacy activation is detected by the Bluetooth™ transceiver 324, which then notifies the HDMI repeater 306 to begin operating in privacy mode. At this point, the HDMI repeater can send an audio infopacket to the HDMI source 314 via a display data channel 330 requesting that the audio sample rate be modified to that supported by the Bluetooth Headset Profile, generally 64 kHz audio.

Alternatively, a controller 332 (e.g., microcontroller, processor, FPGA, and the like) of the HDMI repeater 306 transcodes or otherwise processes the audio data into a different audio data format for the audio headset, such as into Bluetooth-formatted audio data for the Bluetooth™ headset 320. An example of Bluetooth-formatted audio data being generated from HDMI channels is described with reference to FIG. 4.

In this example, the audio control module 318 includes a Consumer Electronics Control (CEC) interface 334 that supports a mute command, which can be sent as a control instruction 336 to a CEC port 338 of the HDMI sink 316 to mute the audio at an audio rendering device if the audio rendering device supports the feature. Alternatively or in addition, different audio control instructions may be communicated from the CEC interface 334 to a CEC port 340 of the HDMI source 314. When the audio data is routed to the transceiver at 328, the HDMI repeater 306 may also continue to route the audio data to the HDMI receiver 304 at the HDMI sink 316. In embodiments, the controller 332 of the HDMI repeater 306 is implemented to limit the audio that would be generated from the audio data 322 at an audio rendering device by asserting a mute signal (e.g., the control instruction 336) on an HDMI AV mute line of the CEC interface 334.

As an alternative to asserting a mute signal to the audio rendering device, the controller 332 of the HDMI repeater 306 can replace the audio data that is communicated to the HDMI receiver 304 with null audio data, or clear the audio data packets from the audio data to limit the audio from being generated at an audio rendering device. An example of an HDMI output with null audio data is described with reference to FIG. 5. The audio control module 318 also includes an Extended Display Identification Data(EDID) flash 342 (or Enhanced-EDID) that stores an EDID structure obtained from an EDID ROM 344 of the HDMI sink 316. The EDID structure of display data can be routed from the HDMI sink 316 to the HDMI source 314 via the audio control module 318 to inform the HDMI source of the display capabilities of a video rendering device. A portion of an EDID data structure is described with reference to FIG. 6, and the data structure includes HDMI VSDB latency fields (e.g., bytes 9-12) that can be adjusted if needed to account for a timing delay between audio and video playback. The audio data processing in the audio control module 318 may introduce the timing delay between the audio data 328 that is communicated to the Bluetooth™ headset 320 and video playback of the video data 312 at a video rendering device.

In an embodiment, the controller 332 of the HDMI repeater 306 in the audio control module 318 can delay the video data 312 being routed to the HDMI sink 316 (e.g., at a video rendering device) to compensate for the additional audio data processing and to maintain synchronization of the audio data and the video data. For example, the audio that a user hears at the Bluetooth™ headset 320 may be delayed relative to the corresponding video data that is displayed for viewing due to processing and routing of the audio data 328 in the audio control module 318. The controller 332 can delay the video data with delay circuitry, such as shift registers 346 in the audio control module 318, to delay the video data stream of the video data for a delay duration that correlates to the audio data processing. Alternatively or in addition, the controller can communicate a request to the HDMI source 314 (e.g., at a media data device) to delay a video data stream of the video data for the delay duration that correlates to the audio data processing.

When a user of the Bluetooth™ headset 320 cancels a privacy mode session, for example by pressing the push-button 122 (FIG. 1) again as a toggle, the transceiver 324 in the audio control module 318 receives the cancel input from the audio headset 320 and cancels the control signal 326 to the HDMI repeater 306. The repeater then discontinues the audio data 328 being routed to the transceiver, and the controller 332 cancels the video data delay that was initiated to account for any timing delay between the audio and video playback due to the additional audio data processing in the audio control module.

Figure 4:
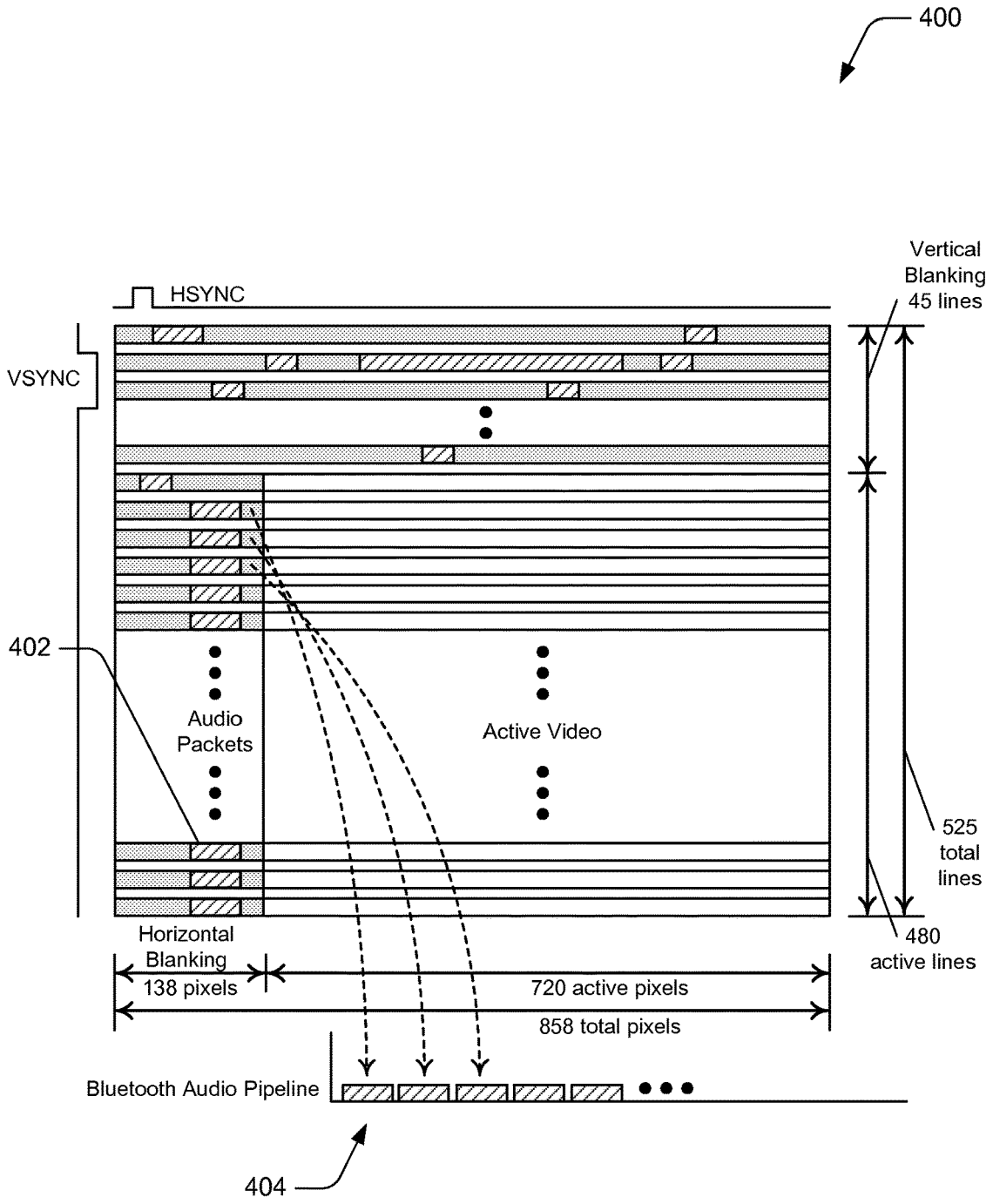
FIG. 4 illustrates an example of Bluetooth™ audio data generated from HDMI channels in an audio control module in accordance with one or more embodiments.

FIG. 4 illustrates an example 400 of Bluetooth™ audio data generated from HDMI channels in an audio control module, such as the audio control modules described with reference to FIGS. 1-3. For example, the audio control module 318 (FIG. 3) receives the audio data 310 from the HDMI source 314. The audio data is received as audio data packets 402, and the controller 332 of the audio control module 318 copies and/or reformats the audio data packets to Bluetooth-formatted audio data 404. In implementations, the audio sample rate of the audio data is modified at the HDMI source 314 to an audio sample rate (e.g., 64 kHz) requested by the HDMI repeater 306 in the audio control module. If the audio sample rate is not modified at the HDMI source, the controller 332 of the audio control module 318 is implemented to provide the audio conversion functionality to generate the 64 khz audio data (e.g., the Bluetooth-formatted audio data 404) that is routed as the audio data at 328 to the transceiver 324 and then wirelessly communicated to the audio headset 320.

Figure 5:
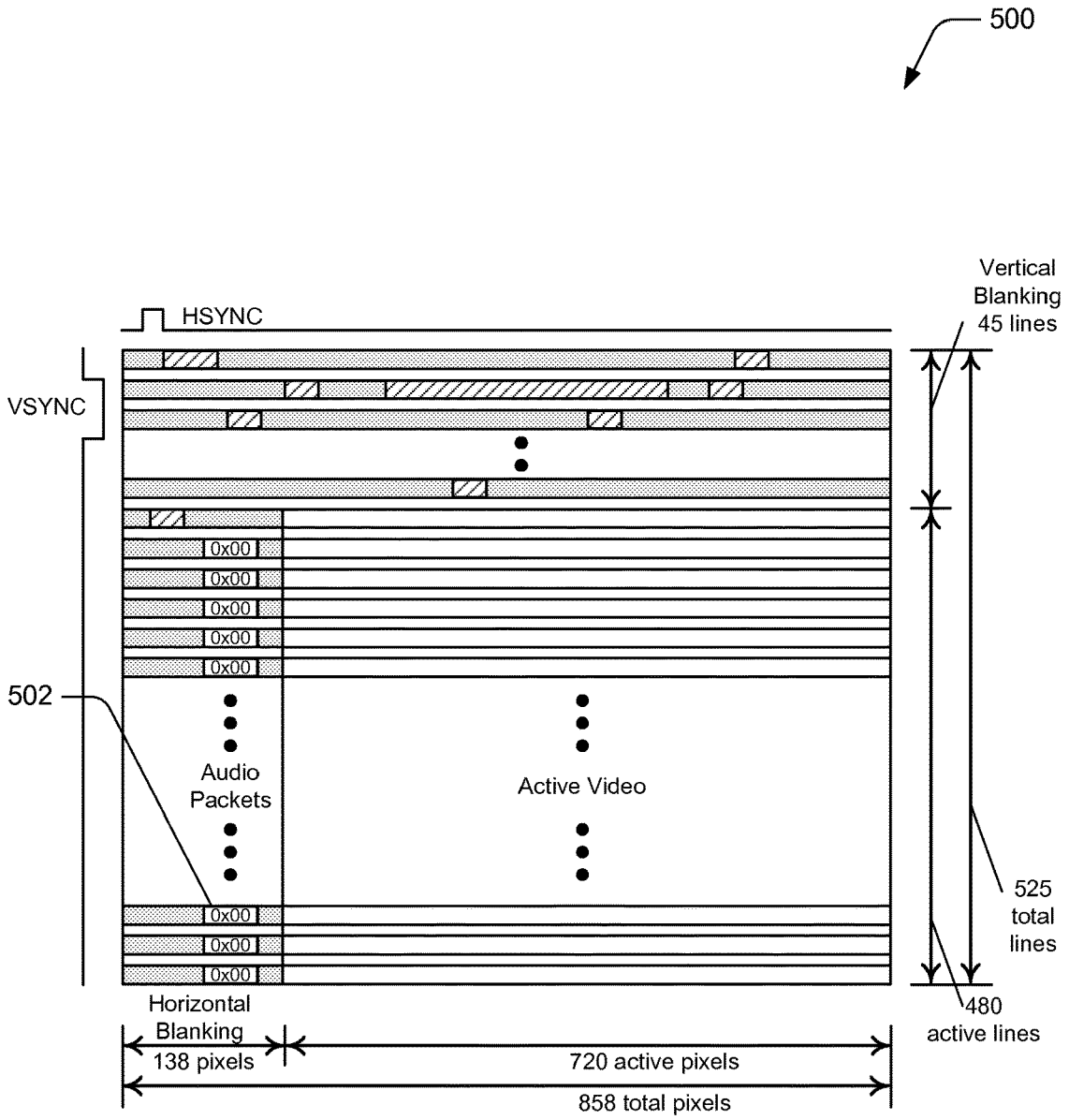
FIG. 5 illustrates an example HDMI output with cleared audio data from an audio control module in accordance with one or more embodiments.

FIG. 5 illustrates an example 500 of an HDMI output with cleared audio data from an audio control module, such as implemented by the audio control modules described with reference to FIGS. 1-3. For example, the audio control module 318 (FIG. 3) receives the audio data 310 from the HDMI source 314. The audio data is received as the audio data packets 402 (FIG. 4), and the controller 332 of the audio control module 318 clears the audio data packets or replaces the audio data with null audio data at 502 (e.g., 0x00), which precludes the audio from being generated at an audio rendering device. The audio control module 318 may implement known audio techniques to gradually NULL out the audio channels to avoid undesired audio artifacts at the HDMI sink 316, such as clicks or popping sounds.

FIG. 6 illustrates an example 600 of the audio and video latency fields 602 in an HDMI Vendor-Specific Data Block (VSDB) that can be adjusted to account for a timing delay between audio and video playback. The additional processing of the audio data in the audio control module 318 (FIG. 3) may introduce the timing mismatch between the audio data at 328 that is communicated to the Bluetooth™ headset 320 and video playback of the video data 312 at a video rendering device. The potential loss of synchronization between the displayed video and the audio at the audio headset 320 can be compensated for by adjusting the audio and video latency fields 602 in the HDMI VSDB. The audio control module 318 can maintain the HDMI VSDB information that is received from the HDMI sink 316, and when a privacy mode is initiated, communicate the HDMI VSDB information to the HDMI source 314 with the audio and video latency fields adjusted to compensate for any loss of synchronization.

Example method 700 is described with reference to FIG. 7 in accordance with one or more embodiments of an audio control module. Generally, any of the methods, components, and modules described herein can be implemented using software, firmware, hardware (e.g., fixed logic circuitry), manual processing, or any combination thereof. A software implementation represents program code that performs specified tasks when executed by a computer processor, and the program code can be stored in computer-readable storage media devices.

Figure 7:
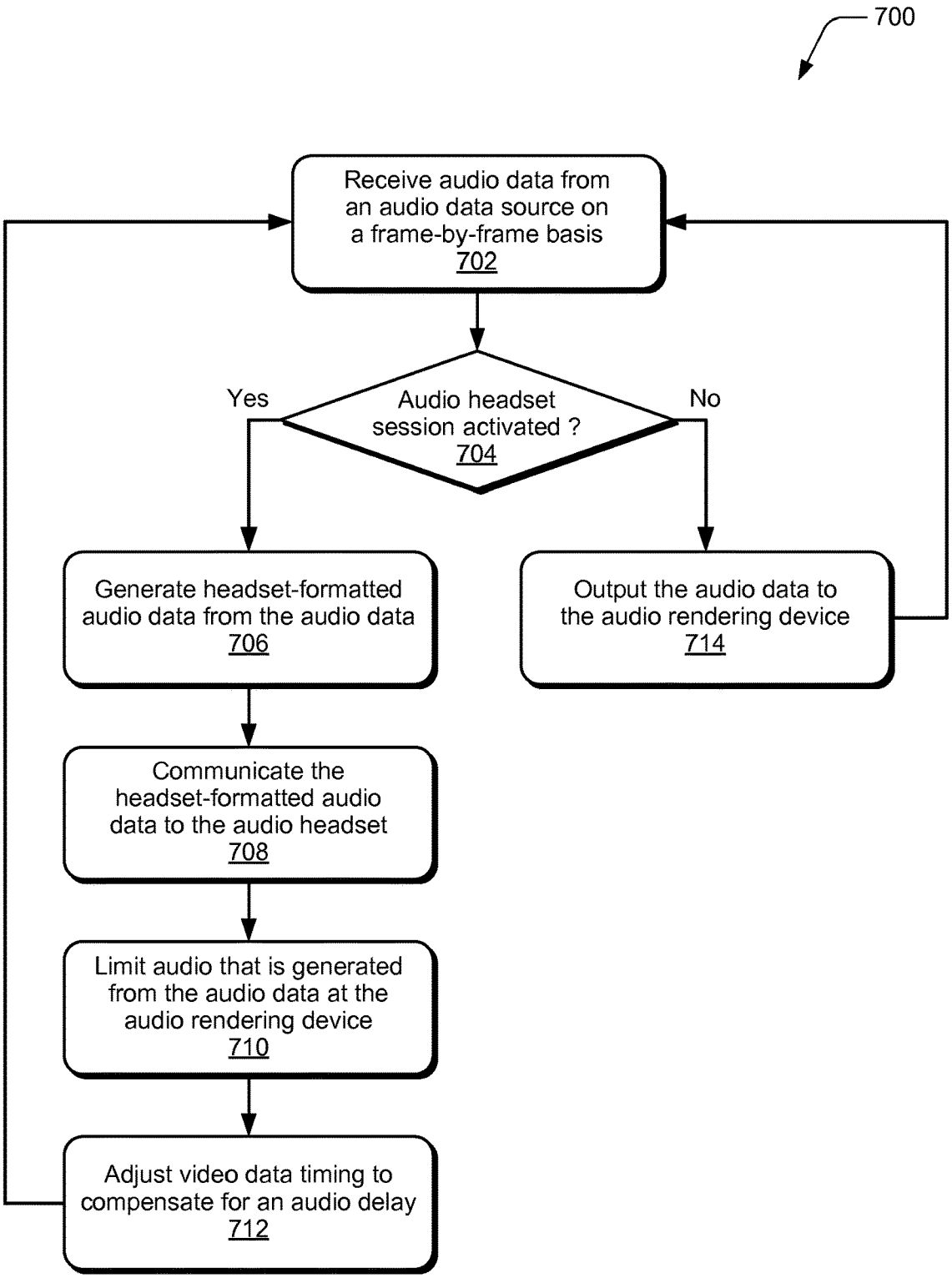
FIG. 7 illustrates example method(s) of an audio control module in accordance with one or more embodiments.

FIG. 7 illustrates example method(s) 700 of an audio control module. The order in which the method blocks are described are not intended to be construed as a limitation, and any number or combination of the described method blocks can be combined in any order to implement a method, or an alternate method.

At block 702, audio data is received from an audio data source on a frame-by-frame basis. For example, the audio control module 118 (FIG. 1) receives the audio data 104 from the electronic device 102 (e.g., an audio data source) that includes the HDMI source 114, such as a media data port of the electronic device. Similarly, the audio control module 318 (FIG. 3) receives the audio data 310 from the HDMI source 314 (e.g., an audio data source) on a frame-by-frame basis.

At block 704, a determination is made as to whether an audio headset session is activated. For example, the audio control module 118 determines when an audio headset session is activated, such as when a user initiates connecting the audio headset 120 with the audio control module by depressing the push-button 122 on the audio headset to enable the privacy mode. Similarly, the audio control module 318 determines when an audio headset session is activated, such as when a user initiates connecting the audio headset 320 with the audio control module by depressing the push-button on the audio headset to enable the privacy mode.

If an audio headset session is activated (i.e., "yes" from block 704), then at block 706, headset-formatted audio data is generated from the audio data. For example, the controller 332 at the audio control module 318 generates the headset-formatted audio data 404 (FIG. 4) from the audio data 310 that is received from the HDMI source 314. At block 708, the headset-formatted audio data is communicated to the audio headset. For example, the HDMI repeater 306 at the audio control module 318 routes the headset-formatted audio data at 328 to the transceiver 324, which then communicates the headset-formatted audio data to the audio headset 320.

At block 710, the audio that would be generated from the audio data at the audio rendering device is limited. For example, the controller 332 of the audio control module 318 asserts a mute signal (e.g., the control instruction 336) on an HDMI AV mute line of the CEC interface 334 to limit the audio that would be generated at an audio rendering device. Alternatively, the controller 332 replaces the audio data that is communicated to the HDMI sink 316 with null audio data at 502 (FIG. 5), or clears the audio data packets from the audio data to limit the audio from being generated at an audio rendering device.

At block 712, video data timing is adjusted to compensate for an audio delay. For example, the controller 332 at the audio control module 318 adjusts video data timing to compensate for a timing mismatch between the headset-formatted audio data received at the audio headset and the corresponding video that is displayed at a display device. The controller can delay the video data with delay circuitry, such as shift registers 346 in the controller 332 of the audio control module to delay the video data stream of the video data for a delay duration that correlates to the audio data processing. Alternatively or in addition, the controller can communicate a request over an EDID line via the VSDB data structure to the HDMI source 314 (e.g., at a media data device) to delay a video data stream of the video data for the delay duration that correlates to the audio data processing. The method then continues at block 702 to receive the audio data from the audio data source on a frame-by-frame basis.

If an audio headset session is not activated (i.e., "no" from block 704), then the audio data is output to the audio rendering device at block 714. For example, the audio control module 318 outputs the audio data 322 to the audio rendering device (e.g., a device that includes the HDMI sink 316). The method then continues at block 702 to receive the audio data from the audio data source on a frame-by-frame basis.

Figure 8:
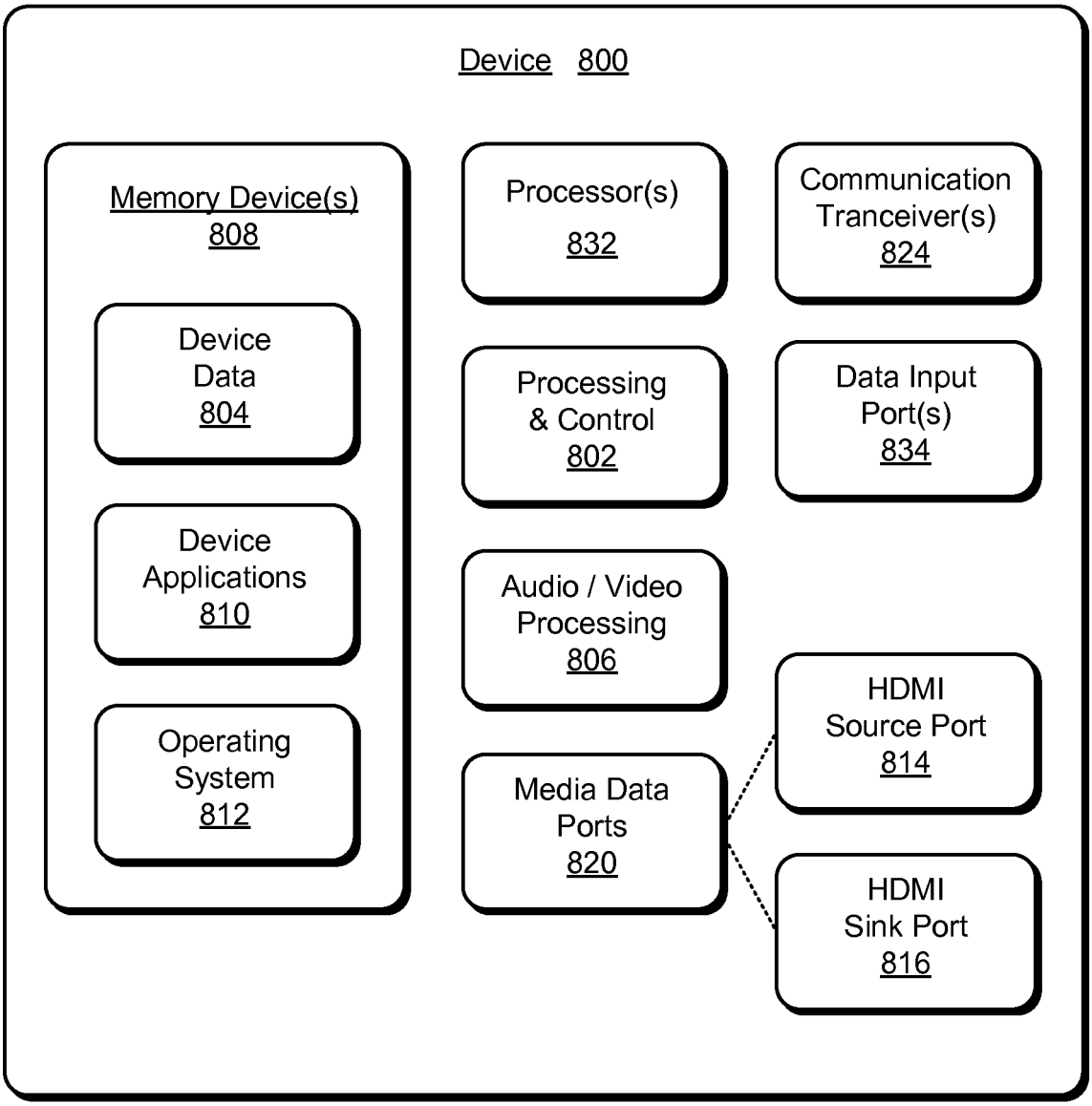
FIG. 8 illustrates various components of an example electronic device that can be implemented as an HDMI source and/or HDMI sink in embodiments of an audio control module.

FIG. 8 illustrates various components of an example electronic device 800 that can be implemented as any device described with reference to any of the previous FIGS. 1-7. For example, the electronic device may be implemented as an audio control module, such as the audio control module 118 described with reference to FIGS. 1 and 2, and the audio control module 318 described with reference to FIG. 3. In embodiments, an audio control module can be implemented as an independent device, or may be built into an HDMI cable.

The electronic device 800 includes communication transceivers 824 that enable wired and/or wireless communication of device data 804, such as received data, data that is being received, data scheduled for broadcast, data packets of the data, etc. The device data 804 is an example of the audio data 104 and/or the video data 106 at the electronic device 102 (FIG. 1). The device data may also include the audio and video data communicated from the HDMI source 314 to the audio control module 318 (FIG. 3), the audio data communicated from the audio control module 318 to the wireless headset 320, and the audio and/or video data communicated from the audio control module 318 to the HDMI sink 316. Example communication transceivers 824, such as the Bluetooth™ transceiver 324, include wireless personal area network (WPAN) radios compliant with various IEEE 802.15 (also referred to as Bluetooth™) standards, wireless local area network (WLAN) radios compliant with any of the various IEEE 802.11 (also referred to as WiFi™) standards, wireless wide area network (WWAN) radios for cellular telephony, wireless metropolitan area network (WMAN) radios compliant with various IEEE 802.15 (also referred to as WiMAX™) standards, and wired local area network (LAN) Ethernet transceivers.

The electronic device 800 may also include one or more data input ports 834 via which any type of data, media content, and/or inputs can be received, such as user-selectable inputs, messages, music, television content, recorded video content, and any other type of audio, video, and/or image data received from any content and/or data source. The data input ports 834 are an example of data ports implemented for the CEC interface 334 and/or the EDID Flash 342 of the audio control module 318. The data input ports 834 may include USB ports, coaxial cable ports, and other serial or parallel connectors (including internal connectors) for flash memory, DVDs, CDs, and the like. These data input ports may be used to couple the electronic device to components, peripherals, and/or accessories.

The electronic device 800 includes one or more processors 832 (e.g., any of microprocessors, controllers, and the like), which process computer-executable instructions to control operation of the device. An example of the processor is the controller 332 that is implemented as a component of the HDMI repeater 306 in the audio control module 318. Alternatively or in addition, the electronic device can be implemented with any one or combination of software, hardware, firmware, or fixed logic circuitry that is implemented in connection with processing and control circuits, which are generally identified at 802. Although not shown, the electronic device can include a system bus or data transfer system that couples the various components within the device. A system bus can include any one or combination of different bus structures, such as a memory bus or memory controller, a peripheral bus, a universal serial bus, and/or a processor or local bus that utilizes any of a variety of bus architectures.

The electronic device 800 also includes one or more memory devices 808 that enable data storage, examples of which include random access memory (RAM) and non-volatile memory (e.g., read-only memory (ROM), flash memory, EPROM, EEPROM, etc.). A memory device 808 provides data storage mechanisms to store the device data 804, other types of information and/or data, and various device applications 810 (e.g., software applications). For example, an operating system 812 can be maintained as software instructions within a memory device and executed on the processors 832. The device applications may also include a device manager, such as any form of a control application, software application, signal-processing and control module, code that is native to a particular device, a hardware abstraction layer for a particular device, and so on.

The electronic device 800 also includes an audio and/or video processing system 806 that processes audio data and/or passes through the audio and video data. An example of the audio and/or video processing system 806 is the HDMI repeater 306 that is implemented in the audio control module 318. The electronic device 800 also includes media data ports 820, such as an HDMI source port 814 via which audio and video data is received from the HDMI source 314, and an HDMI sink port 816 via which the audio and video data is communicated to the HDMI sink 316.

As described above, an audio control module is implemented in-line between an HDMI source and an HDMI sink. From an audio headset, a user can initiate a privacy mode by connecting the audio headset with the audio control module so that audio data from the HDMI source is routed to the audio headset while video data from the HDMI source is routed through to a video rendering device. The audio data from the HDMI source is also routed though the audio control module to an audio rendering device, but is either muted or the audio data is cleared or nulled out to preclude the audio being generated at the audio rendering device. Although embodiments of an audio control module have been described in language specific to features and/or methods, the subject of the appended claims is not necessarily limited to the specific features or methods described. Rather, the specific features and methods are disclosed as example implementations of an audio control module.

The invention claimed is:

1. An audio control module, comprising:

a repeater configured to receive audio data associated with video data from a data source, the repeater further configured to route the audio data to an audio rendering device, and to route the video data and the audio data to a video rendering device;

a controller configured to process the audio data into the audio data format of the audio rendering device, and to delay the video data being routed to the video rendering device to compensate for the audio processing of the audio data, wherein the delay is set to a delay that correlates to the audio processing of the audio data to synchronize the audio generated at the audio rendering device with the video generated at the video rendering device.

2. The audio control module of claim 1, wherein the audio control module is further configured to receive an initialization input from the audio rendering device, and the controller is configured to limit audio generated from the audio data at the video rendering device after receiving the initialization signal.

3. The audio control module of claim 2, wherein the controller is configured to assert a mute signal to limit the audio generated at the video rendering device, replace audio data routed to the video rendering device with null audio data to limit the audio generated at the video rendering device, or clear audio packets from the audio data routed to the video rendering device to limit the audio generated at the video rendering device.

4. The audio control module of claim 1, further comprising a wireless communications transceiver configured to route the audio data to the audio rendering device by wireless communication with the audio rendering device.

5. The audio control module of claim 4, wherein the wireless communications transceiver wirelessly communicates with the audio rendering device using any one of Bluetooth™, Wireless Personal Area Network, or WiFi™ compliant communications.

6. The audio control module of claim 5, wherein the audio rendering device is a Bluetooth™ headset, the controller is configured to process the audio data routed to the audio rendering device into Bluetooth-formatted audio data, and the wireless communications transceiver is a Bluetooth™ transceiver.

7. The audio control module of claim 5, wherein the wireless communications transceiver is a WiFi™ compliant transceiver.

8. The audio control module of claim 1, wherein at least a portion of the audio processing is performed at the audio rendering device.

9. A method, comprising:

receiving audio data associated with video data from a data source;

processing the audio data into the audio data format of an audio rendering device;

delaying video data to be routed to a video rendering device to compensate for the audio processing of the audio data, wherein the delay is set to a delay that correlates to the audio processing of the audio data to synchronize the audio generated at the audio rendering device with the video generated at the video rendering device; and routing the audio data to the audio rendering device, and the video data and the audio data to the video rendering device.

10. The method of claim 9, further comprising:

receiving an initialization input from the audio rendering device; and limiting audio generated from the audio data at the video rendering device after receiving the initialization signal.

11. The method of claim 10, further comprising:

asserting a mute signal to limit the audio generated at the video rendering device, or replacing audio data routed to the video rendering device with null audio data to limit the audio generated at the video rendering device, or clearing audio packets from the audio data routed to the video rendering device to limit the audio generated at the video rendering device.

12. The method of claim 9, wherein routing the audio data to the audio rendering device is performed by wireless communication with the audio rendering device.

13. The method of claim 12, wherein the wireless communication with the audio rendering device is any one of Bluetooth™, Wireless Personal Area Network, or WiFi™ compliant communications.

14. The method of claim 13, wherein the audio rendering device is a Bluetooth™ headset, the audio data routed to the audio rendering device is processed into Bluetooth-formatted audio data, and the wireless communications with the audio rendering device are Bluetooth™ communications.

15. The method of claim 13, wherein the wireless communications with the audio rendering device are WiFi™ compliant communications.

16. The method of claim 9, wherein at least a portion of the audio processing is performed at the audio rendering device.

17. A system, comprising:

a data source for audio data associated with video data;

a repeater configured to receive audio data associated with video data from the data source, the repeater further configured to route the audio data to an audio rendering device, and to route the video data and the audio data to a video rendering device;

a controller configured to process the audio data into the audio data format of the audio rendering device, and to delay the video data being routed to the video rendering device to compensate for the audio processing of the audio data, wherein the delay is set to a delay that correlates to the audio processing of the audio data to synchronize the audio generated at the audio rendering device with the video generated at the video rendering device.

18. The system of claim 17, further comprising a wireless communications transceiver configured to route the audio data to the audio rendering device by wireless communication with the audio rendering device.

19. The system of claim 18, wherein the wireless communications transceiver wirelessly communicates with the audio rendering device using any one of Bluetooth™, Wireless Personal Area Network, or WiFi™ compliant communications.

20. The system of claim 18, wherein the audio rendering device is a Bluetooth™ headset, the controller is configured to process the audio data routed to the audio rendering device into Bluetooth-formatted audio data, and the wireless communications transceiver is a Bluetooth™ transceiver.

* * * * *